United States Patent [19]

Katoh et al.

[11] 4,267,085

[45] May 12, 1981

[54] INJECTION MATERIALS FOR RAILROAD TRACK BEDS

[75] Inventors: Yasuo Katoh; Hideo Kakegawa, both of Tokyo; Shigeyuki Hayashi, Kawasaki; Tadakazu Yamashita, Yokohama, all of Japan

[73] Assignees: Japanese National Railways; Nippon Oil Company, Ltd., both of Tokyo, Japan

[21] Appl. No.: 25,056

[22] Filed: Mar. 29, 1979

Related U.S. Application Data

[63] Continuation-in-part of Ser. No. 708,117, Jul. 23, 1976, abandoned.

[51] Int. Cl.[3] ..... C08F 45/52; C08L 91/00; B44D 1/02

[52] U.S. Cl. ..... 260/28.5 AS; 260/28.5 R; 260/28.5 A; 106/273;270;279; 238/2

[58] Field of Search ..... 260/28.5 AS, 28.5 R, 260/28.5 A, 28.5 AN; 106/279, 273 R, 270

[56] References Cited

U.S. PATENT DOCUMENTS

| | | | |
|---|---|---|---|
| 3,442,841 | 5/1969 | Adelman | 260/28.5 AS |
| 3,669,918 | 6/1972 | Raley, Jr. | 260/28.5 AS |
| 3,703,393 | 11/1972 | Koons | 260/28.5 AS |
| 3,788,883 | 1/1974 | Rostler et al. | 260/33.6 A |
| 3,869,417 | 3/1975 | Ramsay | 260/28.5 AS |
| 3,878,987 | 4/1975 | Uzuka | 238/2 |
| 3,882,066 | 5/1975 | Smith | 260/28.5 AS |
| 3,900,692 | 8/1975 | Rostler | 260/28.5 AS |
| 3,980,598 | 9/1976 | Moorwessel et al. | 260/28.5 AS |

OTHER PUBLICATIONS

C. A. 84:5923x, Minoru et al., "Ethylene Copolymer Adhesive Comp. for Bonding Metals to Plastics".

C. A. 132721j, vol. 83, 1975, Ito et al., "Asphalt Adhesive Comp.".

Derwent 67382v/38, Abs. SU407852, New Bldg. Mats. Inst.

*Primary Examiner*—Joseph L. Schofer

*Assistant Examiner*—Herbert J. Lilling

[57] ABSTRACT

In a railroad track bed an injected layer is formed between the railroad ties and the roadbed so as to protect the latter. The injected layer is composed of an injection material injected through openings formed in the tie. The injection material has a viscosity below 30 poise at a temperature not higher than 200° C. before hardening, and when hardened it has a compressive stress at 10% strain of 0.4 to 30kg/cm$^2$ at a compressive strain rate at 40° C. of 1.5% per minute.

4 Claims, 2 Drawing Figures

INJECTION MATERIALS FOR RAILROAD TRACK BEDS

BACKGROUND OF THE INVENTION

This application is a continuation-in-part application of U.S. Ser. No. 708,117 filed on July 23, 1976, and now abandoned by the same inventors.

This invention relates to injection materials for a railroad track bed in which an injected layer is formed between the railroad tie and the roadbed.

In recent years, the increase in the volume of railroad transportation has been giving rise to a correspondingly sharp increase in the frequency of railroad stock usage, resulting in an increased frequency of maintenance work for the track, in particular, the roadbed. The greater the frequency of train passage, the shorter the time allowable for the maintenance work, and so it has become necessary to provide beds which can contribute to labor-saving in roadbed and track maintenance work. To this end, various studies and efforts have been made in an attempt to replace the conventional ballast roadbed; for example, one proposal is the provision of a concrete roadbed, and another is the suggested use of an integral formation in a ballast roadbed. However, labor saving of maintenance work has not yet been fully attained.

SUMMARY OF THE INVENTION

It is therefore an object of the invention to provide a railroad track bed for which the cycle of maintenance work is prolonged.

Another object of the invention is to provide an injection material which is easily injected onto the roadbed and has a good working property.

A further object of the invention is to provide an injection material which is hard to the extent that it does not undergo a great deformation against compressive stress and which is soft to the extent that is absorbs vibration.

According to a feature of the present invention, there is provided a track bed having an injected layer between the roadbed and the ties mounted thereon. The injected layer serves to uniformly disperse various stresses caused by the passage of a train so as to mitigate the impact force against the roadbed and protect the latter, whereby the cycle of maintenance work can be prolonged.

According to an embodiment of the present invention, the injection material used with the track bed in which a layer of the injection material is formed between the tie and the roadbed has a viscosity below 30 poise at a temperature not higher than 200° C. before hardening, and when hardened it has a compressive stress at 10% strain of 0.4 to 30 kg/cm$^2$, preferably 0.4–15 kg/cm$^2$, more preferably 0.4–5 kg/cm$^2$ at a compressive strain rate at 40° C. of 1.5% per minute.

Other objects, features and advantages of the invention will appear more fully from the following description and from the accompanying drawings.

DETAILED DESCRIPTION OF THE INVENTION

Figure 1:
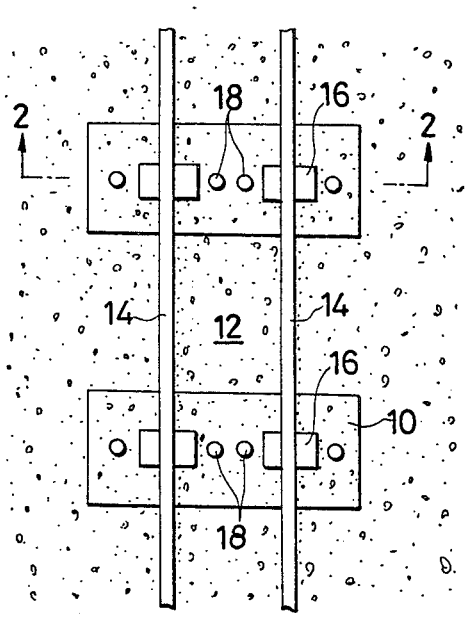
FIG. 1 is a plan view illustrating an embodiment of the track bed according to the present invention.
Figure 2:
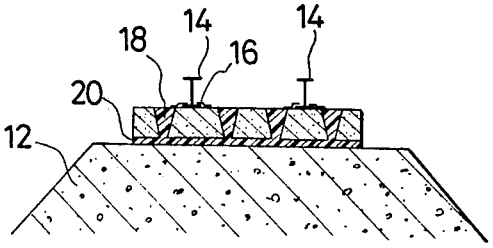
FIG. 2 is a sectional view taken on line 2—2 of FIG. 1.

We shall now describe the invention with particular reference to the accompanying drawings.

Rectangular ties 10 made of concrete or other material are arranged side by side at regular intervals on a ballast roadbed 12 composed of crushed stone, etc. Rails 14 having a H-shaped section are fixed on the ties 10 by means of a clamping device 16 made of iron or the like. The clamping device 16 also acts as a washer for the rail 14. The tie 10 has openings 18 in the form of an inverted circular truncated cone; for example, the top is 8 cm in diameter and the bottom is 6 cm in diameter. Through these openings is injected a fluid injection material. The injected fluid material hardens as the time goes by to form an injected layer 20.

The injected layer 20 in such track structure serves to uniformly disperse various stresses in the roadbed lower structure 12, which stresses occur when a train passes and are transmitted through the tie 10, and at the same time it also serves to absorb as much vibration as possible which is conveyed through the tie 10 the roadbed 12 so as to mitigate any impact force against the roadbed 12 and protect the latter, whereby it is possible to minimize the abrasion of cruched stones and prolong the cycle of maintenance work.

Injection materials for the injected layer 20 should have specific physical properties. That is, it is undesirable for them to undergo greater deformations than required throughout the year against compressive stresses conveyed through the tie 10. On the other hand, if they are too hard, it becomes impossible for them to fully absorb vibration. Further, they should be in a liquid state when injected between the tie 10 and the roadbed 12, or else injection becomes difficult. Therefore, injection materials should be liquid when injected and after having hardened they should be strong, undergo minimum deformation against compressive stress and have a good vibration absorbance.

We have evaluated numerically the various requirements of a train rolling conditions and also have tested many injection materials and checked their properties. At the same time, we have carried out a vibration experiment using a track model consisting of a bed of ties 2 m wide$\times$0.5 m long, in which experiment an injection material was injected between the ties and the roadbed. After the injected material hardened, a 4-ton static load and a 4.5-ton vertical vibration load were simultaneously applied to the ties and a one-million vibrations test was conducted. As a result, we have found that it is possible to determine the properties required of the material and the amount of deformation of the injection material produced by the vibration experiment.

Experiments were also made with respect to the working property of the materials and to their injection requirements. As a result, it has been found that the viscosity of the injection material at the time of injecting is an all important factor to determine their mode of application.

With respect to the injection property, it is preferable that the material to be injected between the tie and the roadbed be in the liquid state and that is form layers. This is advantageous not only for the working property of the material but also to alter the level of the tie as desired even if the roadbed surface is not perfectly regular.

With respect to the injection temperature, it is desirable that the injection be conducted at a temperature below 200° C. so as to prevent damage to the bed constituents because the injection material has to contact concrete products, crushed stones, etc. Further, when the efficiency of injection operation is taken into consideration, it is desirable to use injection materials with viscosities of 30 poise or lower at a temperature below 200° C. However, as set forth hereinbefore, in addition to the injection property, other properties required at time of use are still more important.

When consideration is given to the condition under which the injection material functions after it has hardened, it is necessary to consider the temperature condition for the dynamic properties of the material during operation and service. In particular, during the summer season, this temperature condition becomes important. In this connection, we have checked the temperature distribution in summer by using a track model. As a result, it became clear that the temperature under the tie may be assumed to be 40° C. at its highest. That is, the deformation resistance of the injection material when in service must be checked at a temperature of 40° C. and under this condition the materials must display a satisfactory performance.

There are various forces applied through the tie onto the injection material. However, the compressive stress and shearing stress are the two main forces. What is particularly critical in the injection material is its physical property against the compressive stress. The compressive stress applied through the tie onto the injection material is attributable mainly to the impact force caused by an irregular motion which occurs due to the static load and the rolling of the train. This impact force is an overall force dependent an variations in the conditions of the train and of the track and on the speed of the train. Thus it is extremely difficult to calculate exactly such impact force. For the reasons mentioned above, it would be insufficient to consider only the elastic modulus for the property of the injection material, that is, the concept of loaded speed must also be taken into account.

We have checked the properties of various materials, such as thermoplastic materials and reaction-hardenable materials, and we have also conducted the foregoing load vibration experiment thereon. As a result, it became clear that since the physical property of the injection material is correlated to the amount of deformation of the material at the end of the load vibration experiment, the material should have a compressive stress at 10% strain of 0.4–30 kg/cm$^2$, preferably 0.4–15 kg/cm$^2$, more preferably 0.4–5 kg/cm$^2$ at a compressive strain rate at 40° C. of 1.5% per minute. It also became clear as a result of the experiments that if the value of the compressive stress is above 0.4 kg/cm$^2$, the injection material when in service undergoes little deformation throughout the year. For example, if the tie width is 73.3 cm and the tie spacing is 10 cm, the point below the center of the tie is loaded when the train passes, generally in the following manner, as experimentally demonstrated. When using 50 kg rails, though the train speed also affects, a compressive stress starts to be applied when the wheel weight is about 2.5 to 3.0 m before the load point in question, and when the wheels reach just above the load point in question the point undergoes the maximum compressive stress, which is then gradually decreased.

When the injection material is a visco-elastic body, the conditions are complex and unlike the case with an elastic body. The resistance to deformation under a compressive force is influenced by its loaded speed, it being weak at low loading speeds. For safety sake, therefore, the condition of a low loading speed has been adopted here. That is, if the maximum deformation is 10% when the train rolls at the very low speed of about 25 m/hr, a strain speed of 1.5%/min. is appropriate.

On the other hand, from the standpoint of protection of the roadbed, excessive compressive stress values are not desirable because of vibration absorbance, it being desirable that the value of compressive stress be below 30 kg/cm$^2$.

Thermoplastic materials and reaction-hardenable materials may be used as the injection material according to the present invention only if they satisfy the foregoing properties. As mentioned in application U.S. Ser. No. 708,117, suitable thermoplastic material are, for example, petroleum, natural or synthetic waxes and bituminous substances such as asphalts, pitches and tars, thermoplastic resins such as polyethylene, polypropylene, polystyrene, polyvinyl acetate, thermo plastic polyester, acrylic resins, polyvinyl chloride, polyacrylonitrile, diene polymers, ethylene-vinyl acetate copolymer resin, petroleum resin, cumarone-indene resins, rosin, polybutene, ethylene-propylene copolymer resins, terpene resins, epoxy resins, thermoplastic urethane resin, thermoplastic rubber and sulfur.

On the other hand, still according to U.S. Ser. No. 708,117 a reaction-hardenable material means the combination of a reactive material such as epoxy, urethane, polybutadiene and unsaturated fatty acid system with curing agents for hardening the said reactive material. Also, cement compositions may be used if various rubbers or resins in emulsified state are added thereto. The above-mentioned materials may be used either alone or in combination. In addition, additives such as fibers, fillers, oils, and rubbers may be added.

Now, briefly summarized, the present invention is directed to an injection material for railroad track beds which has, upon being cured, a compressive stress at 10% strain of 0.4–30 Kg/Cm$^2$ a compressive strain at 40° C. of 1.5% per minute, said injection material consisting of one of the following selected mixtures or blends:

(A) a composition of (a) 97–60 wt. % of blown asphalt having a penetration number of 10–30 at 25° C. and (b) 3–40 wt. % of a paraffin wax having a melting point of 35°–200° C., or a microcrystalline wax having a melting point of 35°–200° C., and/or a low molecular weight $C_{2-4}$ polyolefin having an average molecular weight of 500–8000 and a melt flow index of 0.1–100,000;

(B) a blend of 99–80 wt. % of composition (A) given hereabove with 1–20 wt. % of an ethylene-vinyl acetate copolymer having a melting flow index of 0.1–400 and a vinyl acetate content of 5–35 wt. % based on the total amount of the copolymer; and (C) a mixture of 99–80 wt. % of the said blown asphalt mentioned hereabove with 1–20 wt. % of the copolymer mentioned hereabove.

A high molecular weight polyethylene having an average molecular weight of 10,000–100,000 and a melt flow index of 0.01–200 may also be incorporated with the blown asphalt, if desired.

The blown asphalt used in the above-mentioned compositions (1)-(3) should have a penetration number of 0-50, preferably 10-30 for best results.

The paraffin or microcrystalline wax should have a melting point of 35°-200° C. and the low molecular weight polyolefins an average molecular weight of 500-8000 and a melt flow index of 0.1-400 regardless of their crystallinity. When using a polyolefin of $C_{2\sim4}$ having different crystallinities, the desired compressive stress mentioned heretofore may be obtained by adjusting the amount of the wax in the combination.

The ethylene-vinyl acetate copolymer, should have a melt flow index of 0.1-200 and a vinyl acetate content of 5-35 wt.%; variations in the molecular weight are usable by varying the amount of the copolymer to be employed.

The various components which are combined or blended with the blown asphalt may be present in a dispersion state therein.

The present invention will be further illustrated in more detail by way of the following Examples and Controls.

The expression "blown asphalt," "straight asphalt" and "asphalt obtained by propane-deasphaltization" used in this specification refer to those well known in the art.

EXAMPLE 1

An injection material was prepared consisting of 7-tons of blown asphalt (penetration number at 25° C. of 13 and softening point of 97° C.) and 3-tons of a microcrystalline wax (melting point of 180° C.). The blown asphalt was heated to about 180° C. and admixed the microcrystalline wax to form a homogeneous mixture. Compressive stress tests at 10% strain at a compression rate at 40° C. of 1.5% per minute were carried out, using a suitable measuring apparatus of the loadcell type (CLB-500LF manufactured by the Toyo Baldwin Co., Japan).

Following the injection of the material between ties and railroad bed, a vibration test of 3300 cycles/min. and of −0.5-+8.5t in amplitude was applied on a rail to determine the settling amount of the ties.

The initial settling ($C_1$) of the tie (settling amount in mm observed prior to 100,000 vibration cycles) was less than 7 mm and the settling rate ($B_1$) of the tie (expressed by mm/100,000 cycles, observed after more than 100,000 cycles of vibration), was less than 0.012.

Considering that the amount of settling ($C_2$) observed after more than 100,000 vibration cycles is about 45 mm and the settling rate ($B_2$) is about 0.10 when not using the injection materials of the invention, the above initial settling and settling rate of the invention were so small that the ties used in this Example had a maintenance durability (or life) about 5 times greater than in conventional cases not using the invention, test results being shown in Table 1.

EXAMPLE 2

A composition was prepared as described in Example 1 except that 90 wt.% of blown asphalt (penetration number at 25° C. of 25 and softening point of 89° C.) was used in combination with 10 wt.% polyethylene (density 0.922 g/cc and Melt Flow Index of 22 and made by a high pressure process). Tests were carried out to determine the above-mentioned properties as per Example 1, the test results being shown in Table 1.

EXAMPLE 3

Following the procedure of Example 1, a blend was prepared consisting of 85 wt.% of blown asphalt (penetration number at 25° C. of 11 and softening point of 99° C.) and 15 wt.% of low molecular weight polypropylene (average molecular weight of 4000 and softening point of 150° C.). The material was tested as per Example 1 and the test results are shown in Table 1.

EXAMPLE 4

Following the procedure of Example 1, a blend was made consisting of 94 wt.% of blown asphalt (penetration number at 25° C. of 25 and softening point of 89° C.) and 6 wt.% of ethylene-vinyl acetate copolymer (30 wt.% vinyl acetate content and Melt Flow Index of 20). The blend was based as per Example 1 and the test results are shown in Table 1.

EXAMPLE 5

Following the procedure of Example 1, a blend was prepared consisting of 80 wt.% of blown asphalt (penetration number at 25° C. of 14 and softening point of 95° C.), 10 wt% of low molecular weight polyethylene (average molecular weight of 700, made by a high pressure process) and 10 wt.% of polybutene (average molecular weight of 2350). The mixture was tested as in the Example 1 and the test results are shown in Table 1.

EXAMPLE 6

Following the procedure of Example 1, a blend was prepared of 80 wt.% of blown asphalt (penetration at 25° C. of 14 and softening point of 95° C.) and 20 wt.% of paraffin wax (melting point 145° C.). The blend was tested as per Example 1 and the test results are shown in Table 1.

EXAMPLE 7

Following the procedure of Example 1, a blend was prepared of 87 wt.% of blown asphalt (penetration number at 25° C. of 13 and softening point of 97° C.), 10 wt.% of paraffin wax (softening point of 145° C.) and 3 wt.% of ethylene-vinyl acetate copolymer (30 wt.% vinyl acetate content and Melt Flow Index of 20). The blend was tested as per Example 1 and the test results are shown in Table 1.

EXAMPLE 8

(Commercial test)

16 tons of blown asphalt (penetration number at 25° C. of 13 as determined by the method of Japanese Industrial Standard K 2530, and softening point of 97° C.) and 4-tons of a low molecular weight polyethylene (average molecular weight of about 700) were completely melted and mixed together.

The mixture had a viscosity below 5 poises at 200° C. and a compressive stress (upon curing) at 10% strain of 0.62 kg/cm$^2$ at a compressive strain rate at 40° C. of 1.5%/min.

This material was used as an injection material on the Kansai Main Railroad Line, Japan, in March 1974, and the application covered a section of track of 75 m long.

It was injected at 180° C. to form an injected layer about 2 cm thick between the concrete ties (73.3 cm wide and arranged side by side at an interval of 10 cm) and the ballast roadbed (No. 6 crushed stones of 12 mm dia dispersed and rolled), and then it was allowed to cool and harden.

When a check was made in October 1975 (two summers hence) there was observed no deformation of the injected layers.

TABLE 1

| | Composition of injection material (wt. %) | | | Compressive stress at 10% strain at compressive strain rate at 40° C. of 1.5% per min. (kg/cm²) (°C.) | Viscosity-measuring-temperature (c.p.) | Viscosity (mm) | Settling of tie cycle | Settling rate $10^{-2}$mm/10,000 |
|---|---|---|---|---|---|---|---|---|
| Example 1 | blown asphalt, penetration 13, softening pt. 97° C. 70 | + | microcrystalline wax melting pt. 180° C. 30 | 0.77 | 180 | 290 | 5.4 | 0.8 |
| Example 2 | blown asphalt, penetration 11, softening pt. 99° C. 80 | + | polyethylene, density 0.922 melt flow index 22 10 | 0.41 | 200 | 2,900 | 6.9 | 1.2 |
| Example 3 | blown asphalt, penetration 11, softening pt. 99° C. 85 | + | low molecular weight polypropylene, molecular weight 4,000 softening pt. 150° C. 15 | 1.20 | 180 | 800 | 5.0 | 0.9 |
| Example 4 | blown asphalt, penetration 25, softening pt. 89° C. 94 | + | ethylene-vinylacetate copolymer, vinylacetate content 30 wt. % melt flow index 20 6 | 0.58 | 180 | 1,500 | 6.0 | 0.8 |
| Example 5 | blown asphalt, penetration 14, softening pt. 95° C. 85 | + | low molecular weight polyethylene, molecular at. 700 10 | 0.65 | 180 | 1,400 | 4.0 | 1.0 |
| | | + | polybutene, molecular wt. 2350 10 | | | | | |
| Example 6 | blown asphalt, penetration 14, softening pt. 95° C. 80 | + | paraffin wax, melting pt. 145° C. 20 | 0.65 | 180 | 100 | 5.7 | 0.8 |
| Example 7 | blown asphalt, penetration 13, softening pt. 97° C. 87 | + | Paraffin wax, melting pt. 145° C. 10 | | | | | |
| | | + | ethylene-vinyl acetate-copolymer vinylacetate content 30 wt. % melt flow index 20 3 | 1.0 | 190 | 770 | 5.0 | 0.8 |

CONTROL 1

Following the procedure of Example 1 except that a heated and molten mixture was prepared consisting of equal parts (by weight) of a straight asphalt (penetration number of 9) and a blown asphalt (penetration number of 13), a comparative test was carried out, the purpose being to confirm whether or not all mixtures of blown asphalt having a penetration of 10–20 and straight asphalt may be used as the injection material.

Upon curing, the above mixture was found to have a compressive stress of 0.15 kg/cm² at 10% strain at a compression strain rate at 40° C. of 1.5% per minute. The injection material melted and flowed out from the spaces between the railroad ties during the Summer season. After one Summer, a measurement of the tie-settling showed that this was very severe and reached a value of 8 mm.

This test shows that the most important factor required for the injection material is not so much the composition thereof, but rather the specified compressive stress required (<0.4 kg/cm²)

On the contrary, in the case where the injection material has a compressive stress at 10% strain greater than 30 kg/cm² at a compression strain rate at 40° C. of 1.5% per minute upon being cured, a vibration test applied to the rail shows that the injection material cannot absorb satisfactorily the vibration.

CONTROL 2

Following the procedure of Example 1 a blend was prepared consisting of 80 wt.% of asphalt obtained by propane deasphaltization (penetration number of 10 and softening point of 67° C.) and 20 wt.% of atactic polypropylene (average molecular weight of 4000) tests were carried out as per Example 1, the test results being shown in Table 2.

CONTROL 3

Following the procedure of Example 1 a blend was prepared of 90 wt.% of asphalt obtained by propane deasphaltization (penetration number of 10 and softening point of 67° C.) and 10 wt.% polyethylene (average molecular weight of 20,000). Tests were carried out as per Example 1 and the test results are shown in Table 2.

TABLE 2

| | Composition of injection material (wt. %) | | | Compressive stress at 10% strain at compressive strain rate at 40° C. of 1.5% per min. | Viscosity-measuring-temperature (°C.) | Viscosity (c.p.) | Settling of tie (mm) | Settling rate $10^{-2}$mm/10,000 cycles |
|---|---|---|---|---|---|---|---|---|
| Control 2 | P.D.A.* 80 | + | atactic polyproplyene 20 | 0.03 Kg/cm² | 200 | 200 | 10.4 | 3.1 |

TABLE 2-continued

| | Composition of injection material (wt. %) | Compressive stress at 10% strain at compressive strain rate at 40° C. of 1.5% per min. | Viscosity-measuring-temperature (°C.) | Viscosity (c.p.) | Settling of tie (mm) | Settling rate $10^{-2}$mm/10,000 cycles |
|---|---|---|---|---|---|---|
| Control 3 | P.D.A. 90 + P.E. 10 | 0.05 kg/cm$^2$ | 200 | 370 | 10.1 | 3.0 |

*Remark: P.D.A. represents asphalt obtained by a propane deasphalting process.

However, the test results for controls 2 and 3 showed the same drawbacks as described in Control 1, namely insufficient compressive stress value so that the material could not absorb satisfactorily the operational vibrations of the track.

What we claim is:

1. An injection material for railroad track bed and having a compressive stress at 10% strain of 0.4–30 Kg/Cm$^2$ at a compressive strain at 40° C. of 1.5% per minute upon being cured, said injection material consisting of a member selected from (A) a composition of (a) 97–60 wt. % of blown asphalt having a penetration number of 10–30 at 25° C. and (b) 3–40 wt. % of (i) a paraffin wax having a melting point of 35°–200° C. or (ii) a microcrystalline wax having a melting point of 35°–200° C. and/or (iii) a low molecular weight $C_{2-4}$ polyolefin having an average molecular weight of 500–8000 and a melt flow index of 0.1–100,000; and (B) a blend of (c) 99–80 wt. % of said composition (A) with (d) 1–20 wt. % of an ethylene-vinyl acetate copolymer having a melt flow index of 0.1–400 and a vinyl acetate content of 5–35 wt. % based on the total amount of the copolymer.

2. The injection material of claim 1 wherein said injection material consists of a mixture of 97–60 wt. % of said blown asphalt (a) and 3–40 wt. % of said paraffin wax (i) or said microcrystalline wax (ii) and/or said low molecular weight $C_{2-4}$ polyolefin (iii).

3. The injection material of claim 1 wherein said injection material consists of a blend of 99–80 wt. % of said composition (A) with 1–20 wt. % of said ethylene-vinyl acetate copolymer (d).

4. The injection material of claim 1 wherein said injection material further includes a high molecular weight polyethylene having an average molecular weight of 10,000–100,000 and a melt flow index of 0.01–200.

* * * * *